US007331554B2

(12) United States Patent
Cheng

(10) Patent No.: US 7,331,554 B2
(45) Date of Patent: Feb. 19, 2008

(54) EYEGLASSES CLAMPING DEVICE

(76) Inventor: Hsi-Chou Cheng, No. 46, Lane 172, Sec. 2, Cheng-Hsi St., Tainan City (TW)

( * ) Notice: Subject to any disclaimer, the term of this patent is extended or adjusted under 35 U.S.C. 154(b) by 322 days.

(21) Appl. No.: 11/189,924

(22) Filed: Jul. 27, 2005

(65) Prior Publication Data

US 2007/0022573 A1 Feb. 1, 2007

(51) Int. Cl.
*A47G 1/10* (2006.01)
*A44B 21/00* (2006.01)

(52) U.S. Cl. ..... 248/316.7; 248/902; 24/3.3; 24/3.12; 351/112

(58) Field of Classification Search ..... 248/316.7, 248/229.16, 902; 24/3.12, 3.3, 3.8; 351/112, 351/155; D3/266, 219, 263
See application file for complete search history.

(56) References Cited

U.S. PATENT DOCUMENTS 6,210,003 B1 * 4/2001 Chan ..... 351/112
6,564,432 B1 * 5/2003 Kushner ..... 24/3.3
6,728,995 B2 * 5/2004 Ainley et al. ..... 24/3.3
6,938,304 B2 * 9/2005 Chen ..... 24/3.12
6,962,315 B2 * 11/2005 Lee et al. ..... 248/316.1
2002/0010983 A1 * 1/2002 Lee ..... 24/3.12

* cited by examiner

*Primary Examiner*—Anita M. King
(74) *Attorney, Agent, or Firm*—Nixon & Vanderhye P.C.

(57) ABSTRACT

An eyeglasses clamping device includes: a first casing half; a second casing half pivoted to the first casing half and pivotable relative to the first casing half between first and second angular positions, the first and second casing halves defining an inner space therebetween when the second casing half is disposed at the first angular position; and a resilient member secured to the first casing half and having a free end portion that extends into the inner space and that is spaced apart from the first and second casing halves in such a manner to permit the free end portion to urge temples of aneyeglasses, whichare adaptedtobe disposed between the free end portion and the second casing half, against the second casing half when the second casing half is disposed at the first angular position.

3 Claims, 7 Drawing Sheets

EYEGLASSES CLAMPING DEVICE

BACKGROUND OF THE INVENTION

1. Field of the Invention

The invention relates to an eyeglasses clamping device, more particularly to an eyeglasses clamping device with pivoted first and second casing halves and a resilient member extending between the first and second casing halves.

2. Description of the Related Art

As shown in FIG. 1, a conventional eyeglasses clamping device 1 includes a first casing half 11, a second casing half 12 pivotably connected to the first casing half 11, a first cushion 13 mounted on a top side of the first casing half 11, a second cushion 14 mounted on a bottom side of the second casing half 12, and a springy clasping member 15 mounted on a bottom side of the first casing half 11. The first casing half 11 includes a base part 111, a first pivot connecting part 112 extending from the base part 111, a flexible part 113 extending upwardly from a free end of the base part 111, and a press part 114 extending from a top end of the flexible part 113. The second casing half 12 includes a cover part 121, a second pivot connecting part 122 extending from the cover part 121 for pivotably connecting to the first pivot connecting part 112, and a protrusion 123 extending from a free end of the cover part 121. The protrusion 123 is engageable with the press part 114 in a snap engaging manner. Each of the first and second cushions 13, 14 is made from a foam material.

Referring to FIGS. 2 and 3, the eyeglasses clamping device 1 is shown to be used to clamp temples 212 of an eyeglasses 21 and to be mounted on a car sunshade 22 through the clasping member. The eyeglasses 21 have a lens unit 211 disposed on top of the second casing half 12. For clamping, the temples 212 of the eyeglasses 21 are disposed between the first and second cushions 13 ,14 with the lens unit 211 abutting against a top side of the cover part 121. Then, the second casing half 12 is pushed toward the first casing half 11, such that, when the protrusion 123 abuts against the press part 114, by virtue of resiliency of the flexible part 113, the press part 114 is bent so that the protrusion 123 passes over the press part 114 and thereafter, due to the biasing force of the flexible part 113, the protrusion 123 extends beneath and abuts against a bottom side of the press part 114 for holding the first and second casing halves 11, 12 together. Hence, the temples 212 are clamped securely as they are sandwiched between the first and second cushions 13, 14.

Although the aforesaid conventional eyeglasses clamping device 1 is capable of clamping the eyeglasses 21, the clamping action over the temples 212 is realized by virtue of elasticity of the material of the first and second cushions 13, 14. Therefore, after a period of repeated use, the first and second cushions 13, 14 are prone to experience elastic deformation such that the clamping effect is significantly reduced, thereby resulting in a tendency for the eyeglasses 21 to get loose and slide along the cover part 121 of the eye glasses clamping device 1.

SUMMARY OF THE INVENTION

Therefore, the object of the present invention is to provide an eyeglasses clamping device that is capable of overcoming the aforesaid drawbacks associated with the prior art.

Accordingly, there is provided an eyeglasses clamping device that comprises: a first casing half; a second casing half pivoted to the first casing half and pivotable relative to the first casing half between first and second angular positions, the first and second casing halves defining an inner space therebetween when the second casing half is disposed at the first angular position; and a resilient member secured to the first casing half and having a free end portion that extends into the inner space and that is spaced apart from the first and second casing halves in such a manner to permit the free end portion to urge temples of an eyeglasses, which are adapted to be disposed between the free end portion and the second casing half, against the second casing half when the second casing half is disposed at the first angular position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
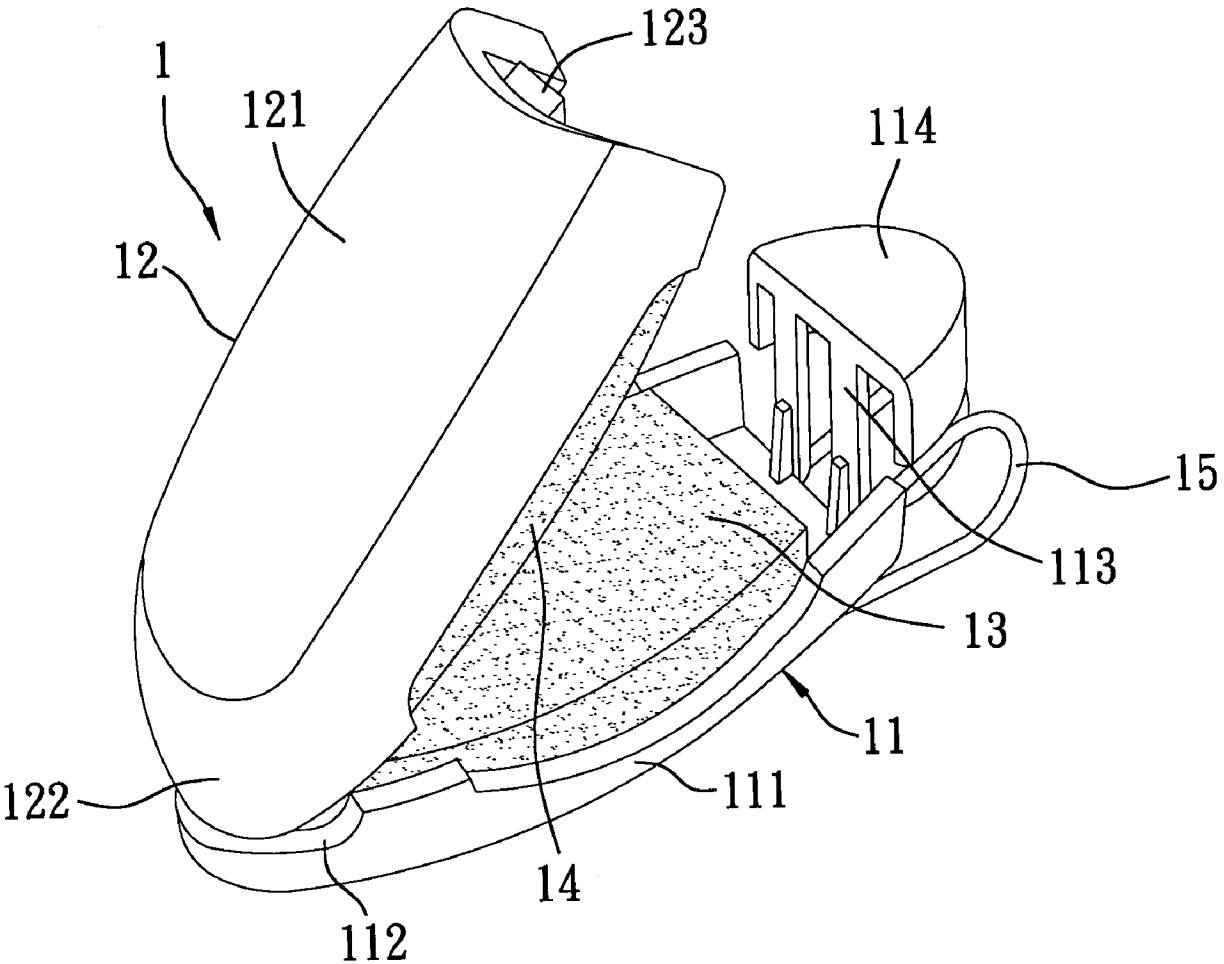
FIG. 1 PRIOR ART
FIG. 1 is a perspective view of a conventional eyeglasses clamping device in an unclamping state.
Figure 2:
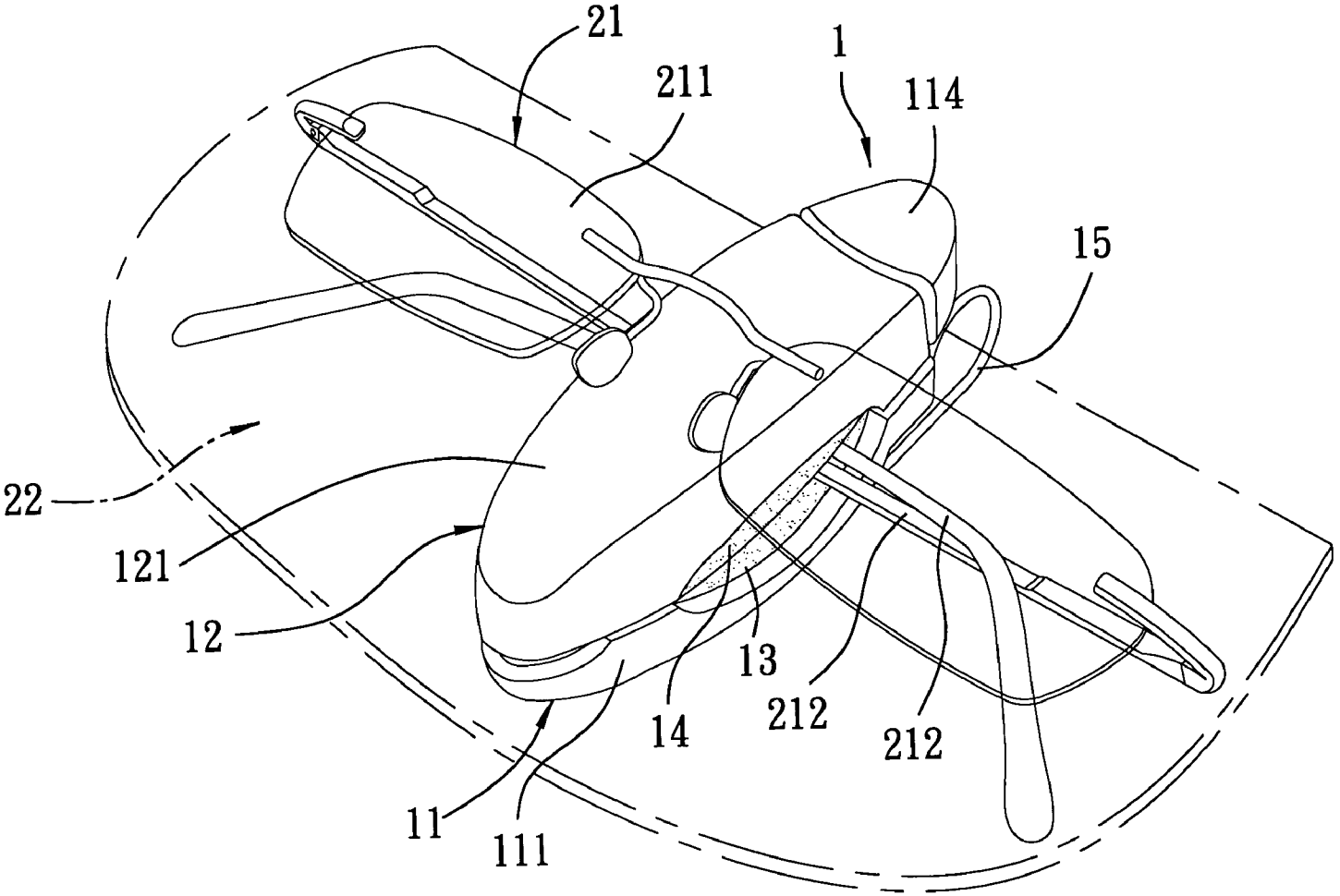
FIG. 2 PRIOR ART
FIG. 2 is a perspective view of the conventional eyeglasses clamping device in a clamping state for clamping a pair of eyeglasses.
Figure 3:
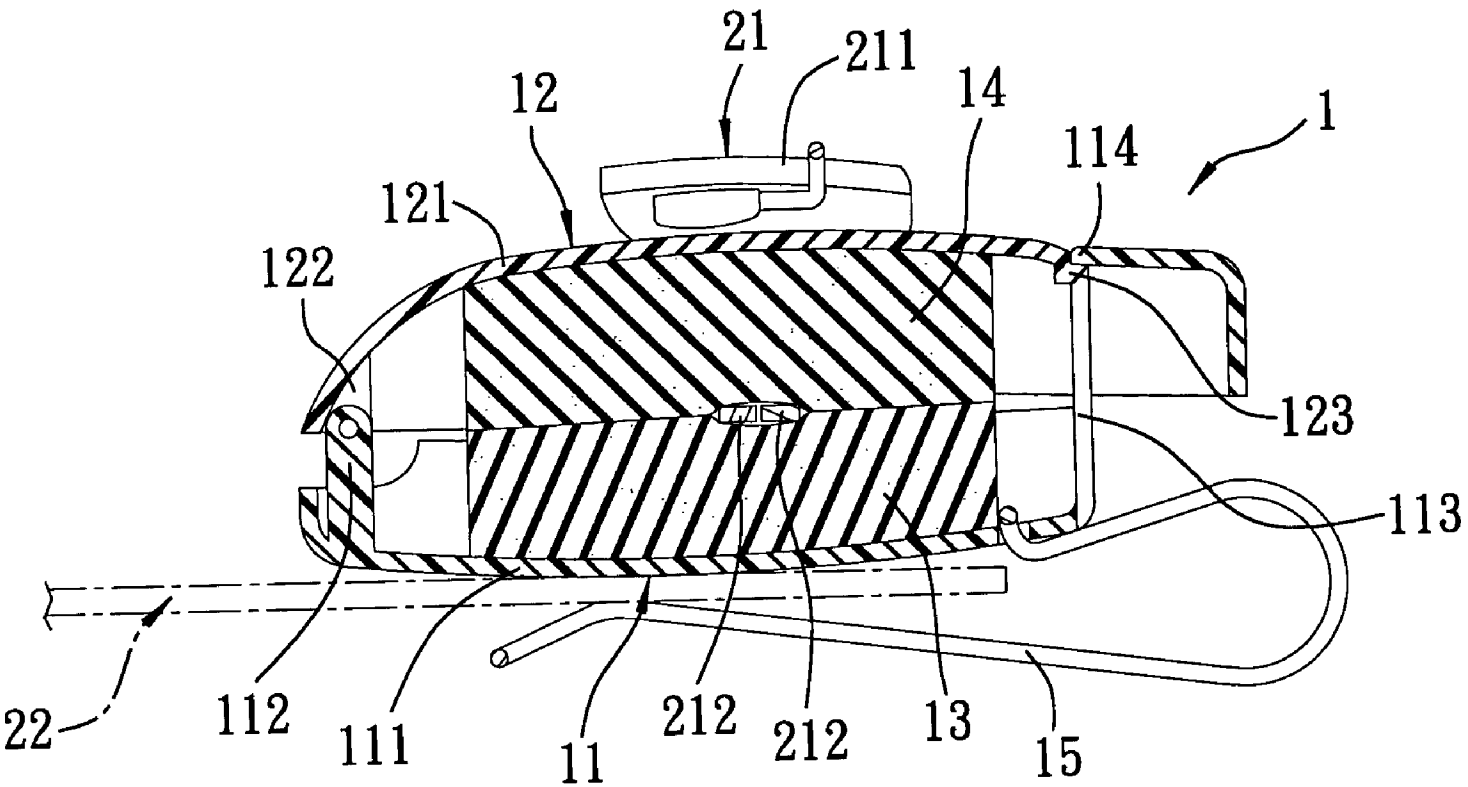
FIG. 3 PRIOR ART
FIG. 3 is a sectional view of FIG. 2.
Figure 4:
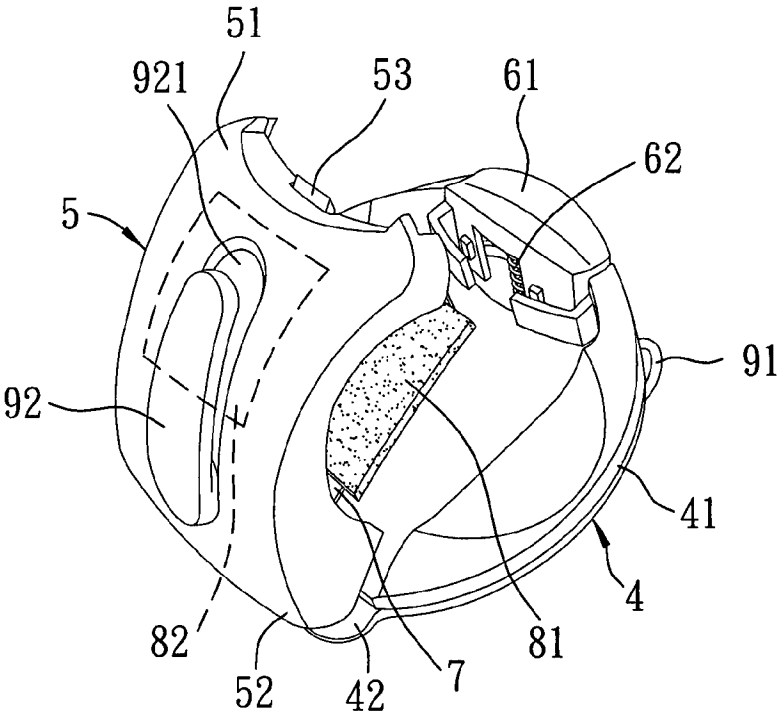
FIG. 4 is a perspective view of the preferred embodiment of the eyeglasses clamping device according to the present invention in an unclamping state.
Figure 5:
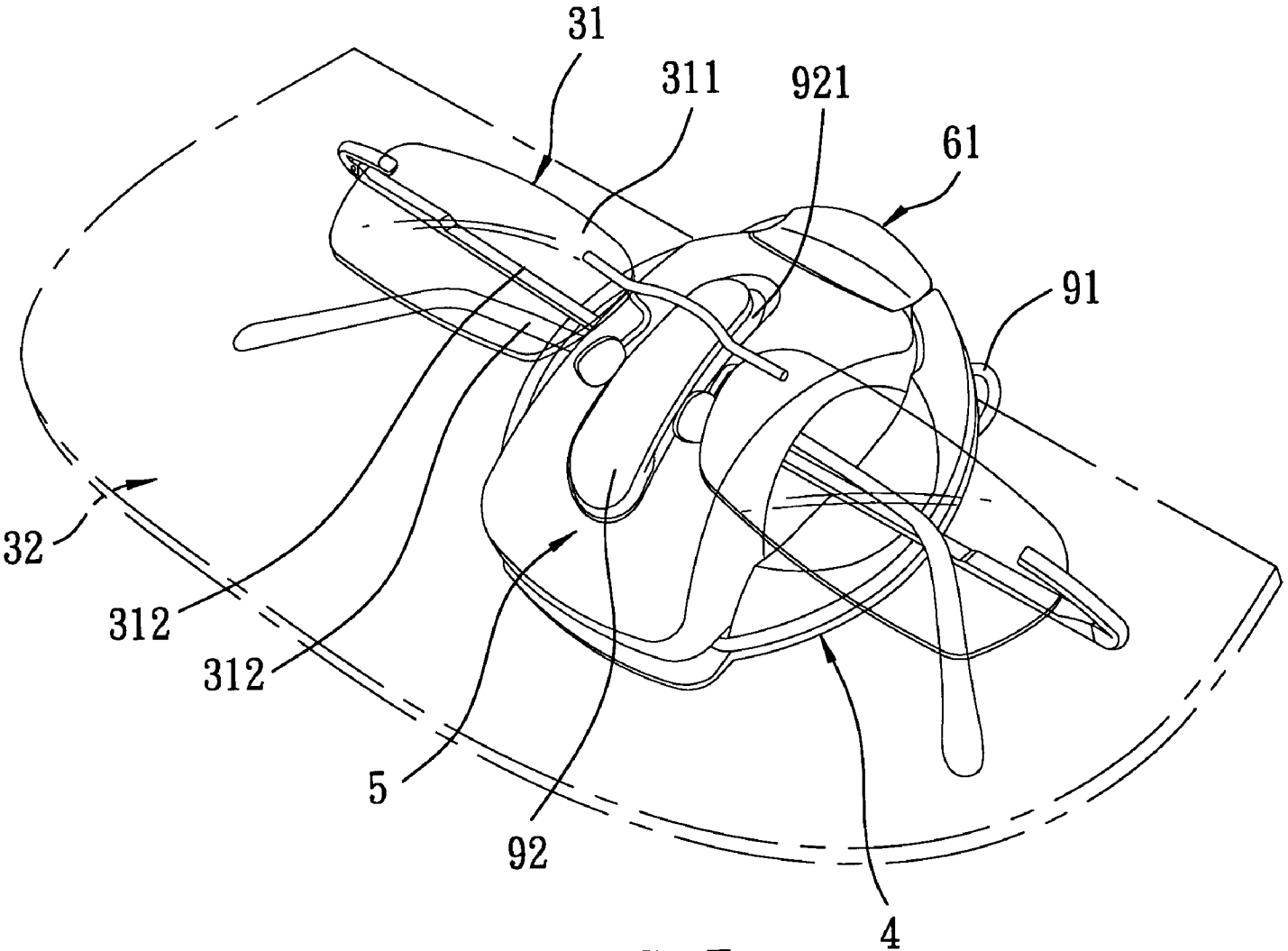
FIG. 5 is a perspective view of the preferred embodiment in a state of clamping temples of an eyeglasses.
Figure 6:
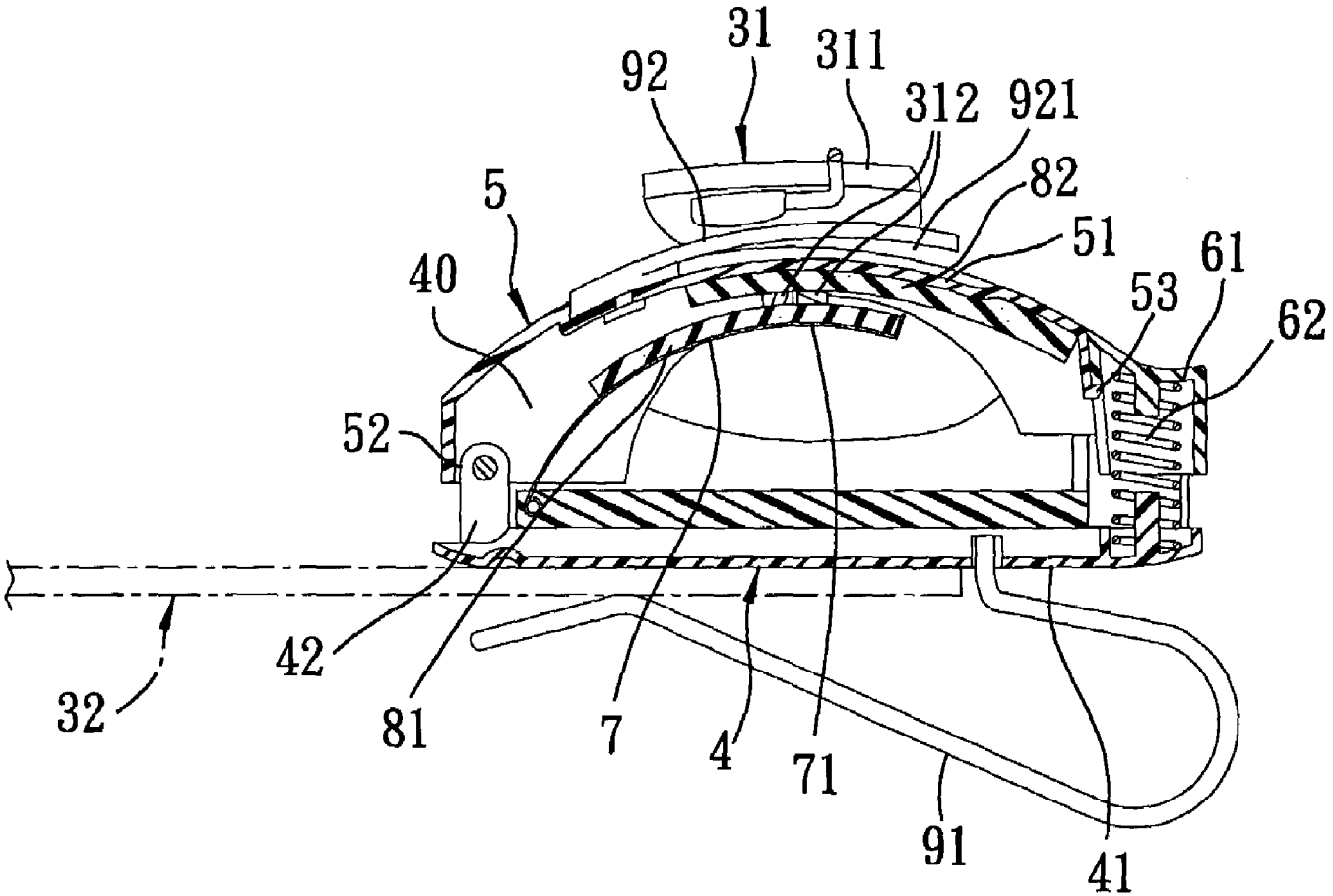
FIG. 6 is a sectional view of FIG. 5.

Referring to FIGS. 4 to 6, the preferred embodiment of an eyeglasses clamping device according to the present invention is shown to be adapted for clamping temples 312 of an eyeglasses 31, and for mounting on a car sunshade 32 in a clamping manner. The eyeglasses 31 have a lens unit 311. In practice, the clamping device maybe applied to other pieces and objects, such as a waist belt.

The eyeglasses clamping device includes: a first casing half 4; a second casing half 5 pivoted to the first casing half 4 and pivotable relative to the first casing half 4 between first and second angular positions (see FIGS. 6 and 4), the first and second casing halves 4, 5 defining an inner space 40 (see FIG. 6) therebetween when the second casing half 5 is disposed at the first angular position; and a resilient member 7 secured to the first casing half 4 and having a free end portion 71 that extends into the inner space 40 and that is spaced apart from the first and second casing halves 4, 5 in such a manner to permit the free end portion 71 to urge the temples 312 of the eyeglasses 31 (see FIG. 6), which are adapted to be disposed between the free end portion 71 and the second casing half 5, against the second casing half 5 when the second casing half 5 is disposed at the first angular position.

In this embodiment, the resilient member 7 is in the form of a resilient thin plate and that extends curvedly from the first casing half 4 into the inner space 40. A first cushion 81 is attached to the resilient member 7, and is disposed between the resilient member 7 and the second casing half 5. A second cushion 82 is provided on the second shell half 5, and cooperates with the first cushion 81 to sandwich the temples 312 therebetween when the second casing half 5 is disposed at the first angular position.

The first casing half 4 has front and rear ends 41, 42. The second casing half 5 has front and rear ends 51, 52. The rear ends 42, 52 of the first and second casing halves 4, 5 are pivoted to each other. A first engaging member 61 is mounted movably on the front end 41 of the first casing half 4. A second engaging member 53, which is in the form of a protrusion, is formed on the front end 51 of the second casing half 5, and engages releasably the first engaging member 61 in a snap engaging manner when the second casing half 5 is disposed at the first angular position. The first engaging member 61 is rotated frontwardly when pressed by the second engaging member 53 during closing movement of the second casing half 5. An urging member 62 abuts against the first engaging member 61 and the front end 41 of the first shell half 4 for restoring the first engaging member 61 to its normal position when the second engaging member 53 passes over the first engaging member 61 to abut against a bottom side of the first engaging member 61.

Figure 7:
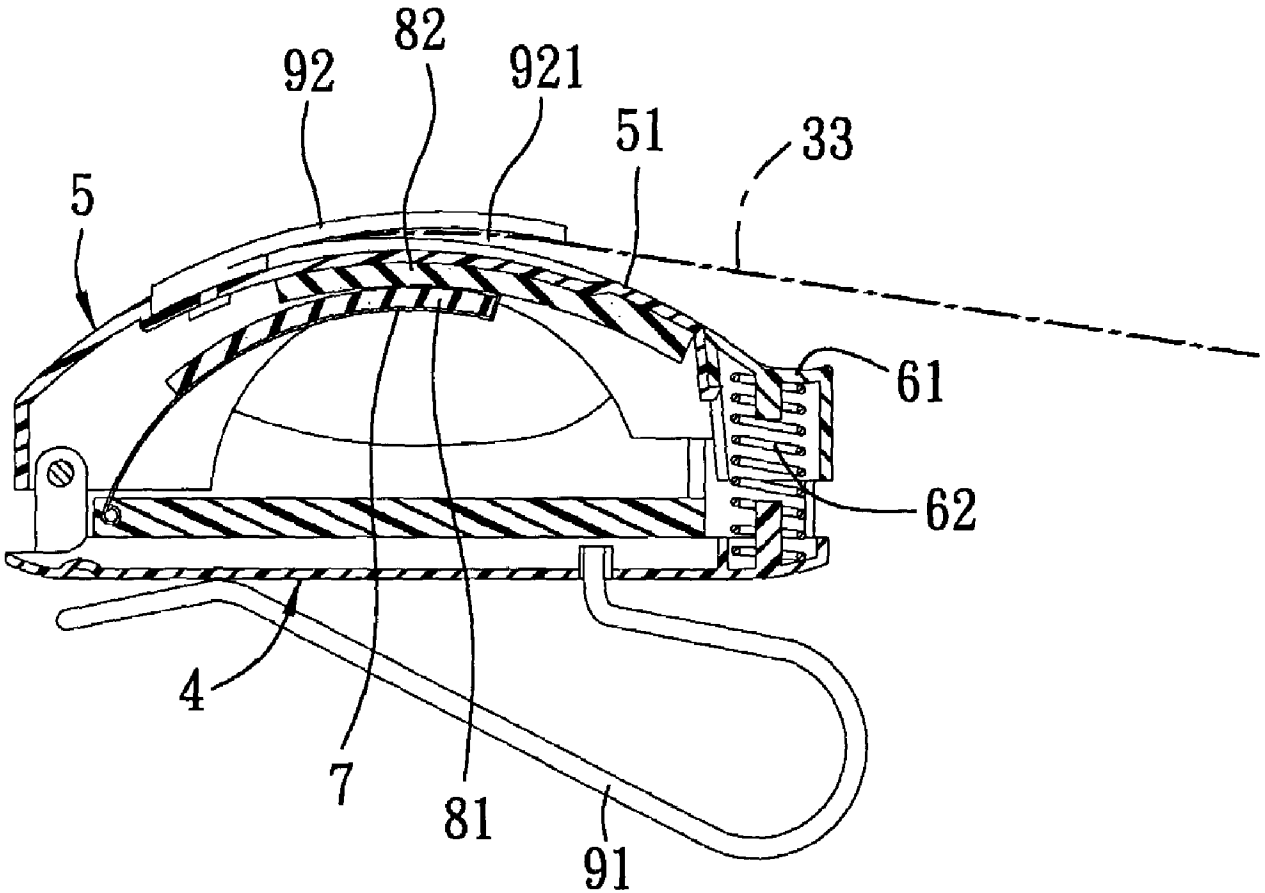
FIG. 7 is a sectional view to illustrate how a thin article is clamped by a resilient tab of the preferred embodiment.

A resilient tab 92 is disposed at one side of the second casing half 5 opposite to the second cushion 82, extends from the second casing half 5, and cooperates with the second casing half 5 to define a clearance 921 therebetween for insertion of a thin article 33, such as a name card, therein (see FIG. 7).

A resilient clasping member 91 is mounted on a bottom side of the first casing half 4 for attaching the eye glasses clamping device to the sunshade 32 by clamping the sunshade 32.

With the inclusion of the resilient member 7 in the eyeglasses clamping device of this invention, the aforesaid drawbacks associated with the prior art can be alleviated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An eyeglasses clamping device comprising:

a first casing half;

a second casing half pivoted to said first casing half and pivotable relative to said first casing half between first and second angular positions, said first and second casing halves defining an inner space therebetween when said second casing half is disposed at said first angular position; and a resilient member secured to said first casing half and having a free end portion that extends into said inner space and that is spaced apart from said first and second casing halves in such a manner to permit said free end portion to urge temples of an eyeglasses, which are adapted to be disposed between said free end portion and said second casing half, against said second casing half when said second casing half is disposed at said first angular position;

wherein said resilient member is in the form of a resilient thin plate and that extends curvedly from said first casing half into said inner space;

wherein said resilient member further includes a first cushion that is attached to said resilient member and that is disposed between said resilient member and said second casing half; and wherein said second casing half is provided with a second cushion that cooperates with said first cushion to sandwich the temples therebetween when said second casing half is disposed at said first angular position.

2. The eyeglasses clamping device as claimed in claim 1, wherein said first casing half has front and rear ends, said second casing half having front and rear ends, said rear ends of said first and second casing halves being pivoted to each other, said eyeglasses clamping device further comprising a first engaging member that is mounted on said front end of said first casing half, and a second engaging member that is formed on said front end of said second casing half and that engages releasably said first engaging member in a snap engaging manner when said second casing half is disposed at said first angular position.

3. The eyeglasses clamping device as claimed in claim 1, further comprising a resilient tab that is disposed at one side of said second casing half opposite to said second cushion, that extends from said second casing half, and that cooperates with said second casing half to define a clearance therebetween for insertion of a thin article therein.

* * * * *